US007439916B2

(12) United States Patent
Wang et al.

(10) Patent No.: US 7,439,916 B2
(45) **Date of Patent: *Oct. 21, 2008**

(54) ANTENNA FOR MOBILE COMMUNICATION TERMINALS

(75) Inventors: Hanyang Wang, Witney (GB); Stuart Williams, Fleet (GB)

(73) Assignee: Nokia Corporation, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/004,991

(22) Filed: Dec. 21, 2007

(65) Prior Publication Data

US 2008/0129612 A1 Jun. 5, 2008

Related U.S. Application Data

(63) Continuation of application No. 11/019,412, filed on Dec. 21, 2004, now Pat. No. 7,339,528.

(30) Foreign Application Priority Data

Dec. 24, 2003 (GB) ..... 0330052.2

(51) Int. Cl.
*H01Q 1/38* (2006.01)
*H01Q 19/00* (2006.01)
*H01Q 1/48* (2006.01)

(52) U.S. Cl. ..... 343/700 MS; 343/833; 343/846

(58) Field of Classification Search ..... 343/700 MS, 343/702, 833, 844, 846, 848
See application file for complete search history.

(56) References Cited

U.S. PATENT DOCUMENTS

| | | | | |
|---|---|---|---|---|
| 6,552,686 | B2 | 4/2003 | Ollikainen et al. | 343/700 MS |
| 6,714,162 | B1 * | 3/2004 | Kadambi et al. | 343/700 MS |
| 6,795,028 | B2 | 9/2004 | Stutzman et al. | 343/702 |
| 6,831,307 | B2 | 12/2004 | Fujii | 257/180 |
| 6,903,687 | B1 * | 6/2005 | Fink et al. | 343/700 MS |
| 6,909,402 | B2 | 6/2005 | Vance | 343/702 |
| 2002/0171595 | A1 | 11/2002 | Schultze et al. | 343/770 |

FOREIGN PATENT DOCUMENTS

| | | |
|---|---|---|
| GB | 2 147 744 A | 5/1985 |
| WO | WO 2004/025776 A2 | 3/2004 |

* cited by examiner

*Primary Examiner*—Shih-Chao Chen
(74) *Attorney, Agent, or Firm*—Harrington & Smith, PC

(57) ABSTRACT

An antenna comprising: a first substantially planar ground plate; a first substantially planar resonator positioned in a plane substantially parallel to the first ground plate; a second substantially planar ground plate positioned in a plane substantially parallel to the first ground plate; two or more connectors for electrically connecting the second ground plate to ground; and one or more connectors for electrically connecting the first resonator to the second ground plate; wherein the first resonator and the second ground plate are connected to at least one of receiver means and transmitter means by antenna feeding means.

31 Claims, 5 Drawing Sheets

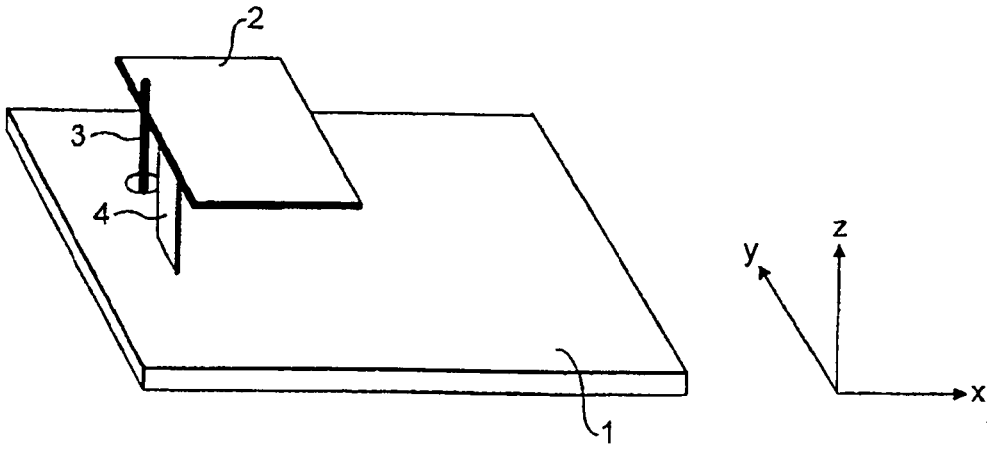
FIG. 1A: Prior Art
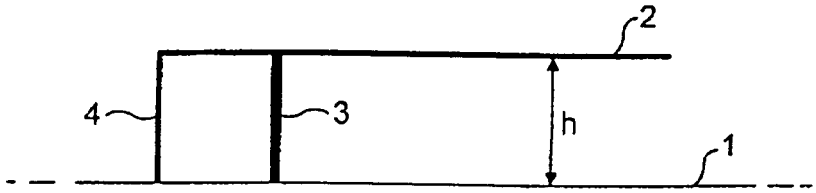
FIG. 1B: Prior Art
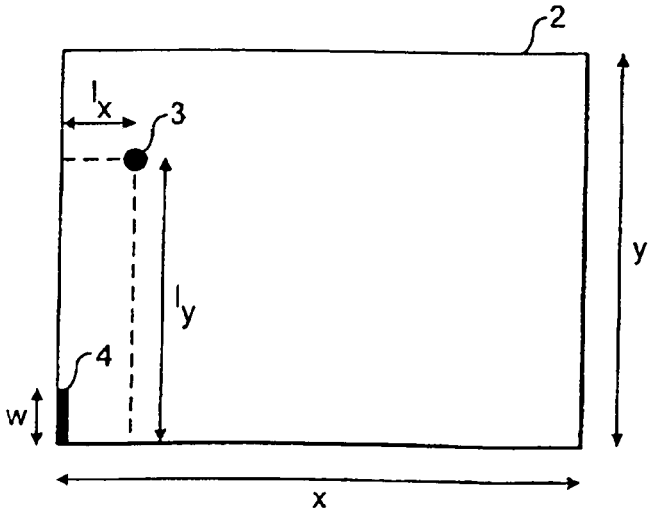
FIG. 1C: Prior Art

ANTENNA FOR MOBILE COMMUNICATION TERMINALS

This application is a continuation of U.S. patent application Ser. No. 11/019,412 filed on Dec. 21, 2004, now U.S. Pat. No. 7,339,528, and through that application claims priority to GB 033052.2 filed on Dec. 24.2003.

FIELD OF INVENTION

The present invention relates to radio frequency antennas for use in mobile communication terminals. More particularly, it relates to providing multiple-band resonances and/or wider bandwidth resonances in mobile terminals.

BACKGROUND OF THE INVENTION

It is known in the field of mobile communications to use PIFA's (planar inverted-F antennas) to achieve a relatively large bandwidth at particular frequencies that may be used for the transmission and reception of mobile communications. Such a prior art PIFA is shown in FIG. 1. FIG. 1A shows a ground plane 1 with a conducting plate 2 mounted above it by means of a short circuit plate 4. FIG. 1B shows a side view of the PIFA and FIG. 1C shows a top view of the conducting plate 2. The frequencies at which a PIFA produces resonances, and the bandwidths of generated frequencies depend on the geometry of the PIFA. Relevant parameters include the length and width of the conducting plate 2 (x and y); the position of the connecting wire 3 ($I_x$, $I_y$); the width of the short circuit plate 4 (w); the height of the conducting plate 2 above the ground plane 1 (h); and the radius of the wire 3. These parameters can be adjusted to provide optimal bandwidth at a particular frequency. The plate 2 will typically be a quarter wave structure.

It is also known to use a double PIFA antenna, in which an additional resonator, or parasitic resonator, is positioned between the ground plane and the main resonator and parallel to them. Such a configuration is shown in FIG. 2. Above the ground plane 21 is a parasitic resonator 25, and above that is a main resonator 22. These three components are electrically connected together by means of a short circuit plate 24. In addition, a feed cable 23 passes through a hole in the ground plane 21 and a hole in the parasitic resonator 25, and the inner conductor of the feed cable ("source +") makes electrical contact with the main resonator 22. The outer conductor ("source −", or ground) is connected to the ground plane 21. This arrangement provides a greater bandwidth than is achievable with a single PIFA. In addition, the parasitic resonator can provide an extra resonance. The parasitic resonator is excited indirectly by the main resonator, rather than directly by the feeding cable. This geometry (FIG. 2) is a variation on the well known 'PIFA with parasitic element' design, where the parasitic element is placed largely in the same plane and adjacent to the main resonator. In the structure of FIG. 2, the main resonator 22 and the parasitic resonator 25 are both quarter wave plates.

The frequency bands used in GSM mobile communication systems are currently USGSM850, EGSM900, DCS1800, and PCS1900. USGSM is a frequency band commonly used in North America; EGSM is used in Europe and ranges from around 880 to 960 MHz; DCS1800 is a common "digital cellular service" band ranging from 1710 to 1880 MHz; and PCS1900 is a common "personal communications service" frequency band. Mobile telephones that are capable of transmitting and receiving signals at all of these frequency bands are known as "quad-band". It is known in the field of mobile communications to use a slotted PIFA pair antenna (see U.S. Pat. No. 6,621,455 entitled "Multi-band Antenna") to achieve resonance at frequencies within the four GSM bands.

A slotted PIFA pair antenna is shown in FIG. 3A. This configuration behaves as two adjacent PIFA's. A printed circuit board 31 acts as a ground plane of the antenna. A planar conductive layer 32B, comprised of copper or any other highly conductive material with slots 35 etched out it, forms a radiating element. The geometry of this layer dictates the resonant frequencies obtainable by the antenna and their bandwidths. The conductive layer 32B is typically supported by an insulating substrate 32A.

Conducting pins 30 are used to ground the conductive layer 32B, and a feed is provided on the underside of the supporting substrate 32A. FIG. 3B shows a detailed view of the feeding structure of this slotted PIFA pair. Typically, a coaxial cable would be used to feed the antenna. The inner and outer conductors of the cable would be connected to different points on the antenna structure. In FIG. 3B, 34A is a conductive strip connected to "source +" and this strip is positioned along the centre of the substrate 32A, preferably extending parallel to the slot 35. 34B is connected to "source −" and protrudes from the printed circuit board 31. There is a small gap between the feed strips 34A and 34B. The coaxial cable connects the antenna to transmitter and receiver circuitry.

It has been found that such a slotted PIFA pair antenna is less effective for telecommunications handsets whose covers are made substantially of metal. In the case of metal mobile terminals, the bandwidth achievable by a slotted PIFA pair antenna such as that shown in FIGS. 3A and 3B is significantly worse compared with non-metal terminals at the lower GSM band (USGSM850 and EGSM900). 30-40% bandwidth reduction is experienced with metal handsets due to the large metal blocks used therein. However, metal handsets have an appearance of quality and luxury and are aesthetically appealing. It is therefore desirable to produce a quad-band mobile handset that may be made of metal.

SUMMARY OF THE INVENTION

According to one aspect of the present invention there is provided an antenna comprising: a first substantially planar ground plate; a first substantially planar resonator positioned in a plane substantially parallel to the first ground plate; a second substantially planar ground plate positioned in a plane substantially parallel to the first ground plate; two or more connectors for electrically connecting the second ground plate to the first ground plate; and one or more connectors for electrically connecting the first resonator to the second ground plate; wherein the first resonator and the second ground plate are connected to at least one of receiver means and transmitter means by antenna feeding means.

According to a second aspect of the present invention there is provided a mobile communication terminal comprising an antenna, the antenna comprising: a first substantially planar ground plate; a first substantially planar resonator positioned in a plane substantially parallel to the first ground plate; a second substantially planar ground plate positioned in a plane substantially parallel to the first ground plate; two or more connectors for electrically connecting the second ground plate to the first ground plate; and one or more connectors for electrically connecting the first resonator to the second ground plate; wherein the first resonator and the second ground plate are connected to at least one of receiver means and transmitter means by antenna feeding means.

According to a third aspect of the present invention there is provided an antenna for use in a mobile communications terminal having a first substantially planar ground plate, the antenna comprising: a first substantially planar resonator positioned in a plane substantially parallel to the first ground plate; a second substantially planar ground plate positioned in a plane substantially parallel to the first ground plate; two or more connectors for electrically connecting the second ground plate to the first ground plate; and one or more connectors for electrically connecting the first resonator to the second ground plate; wherein the first resonator and the second ground plate are connected to at least one of receiver means and transmitter means by antenna feeding means.

Preferred features of the present invention are set out in the dependent claims.

BRIEF DESCRIPTION OF THE DRAWINGS

The present invention will now be described by way of example with reference to the accompanying drawings in which:

FIG. 1 shows a prior art planar inverted-F antenna;

In the drawings, like reference numerals are used to refer to like parts.

DETAILED DESCRIPTION

The inventors of the present invention have found that significant improvements in antenna performance may be achieved, compared with a standard PIFA, by introducing an additional ground plane between the ground plane 1 of FIG. 1A and the conducting sheet 2.

Figure 2:
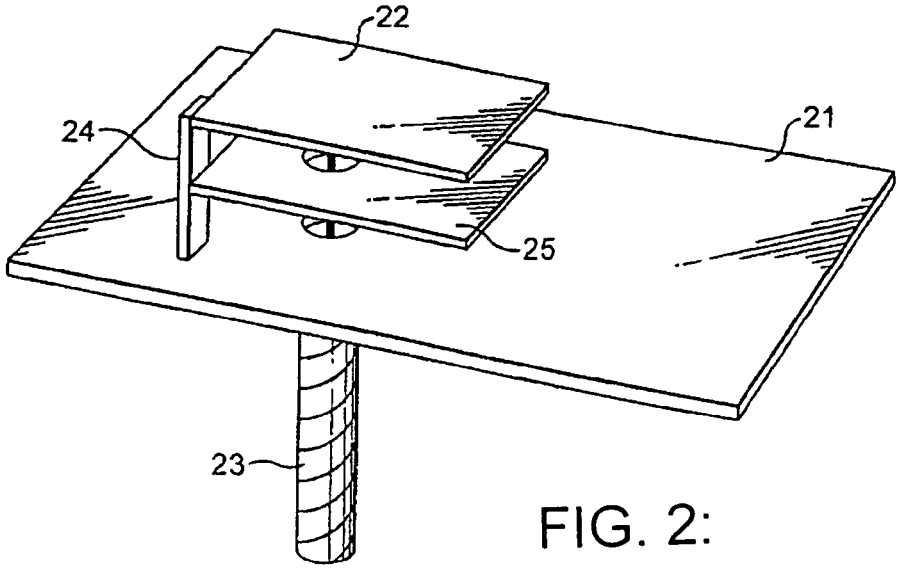
FIG. 2: Prior Art
FIG. 2 shows a prior art double PIFA antenna (PIFA)

In general, if two or more ground connections are made between a conducting plate and ground, then the plate will act as an additional ground plane rather than as a parasitic resonator such as that shown as 25 in the prior art structure illustrated in FIG. 2. As discussed further below, the positions of the ground connections affect the frequency at which the additional ground plane will provide resonance.

Figure 4A:
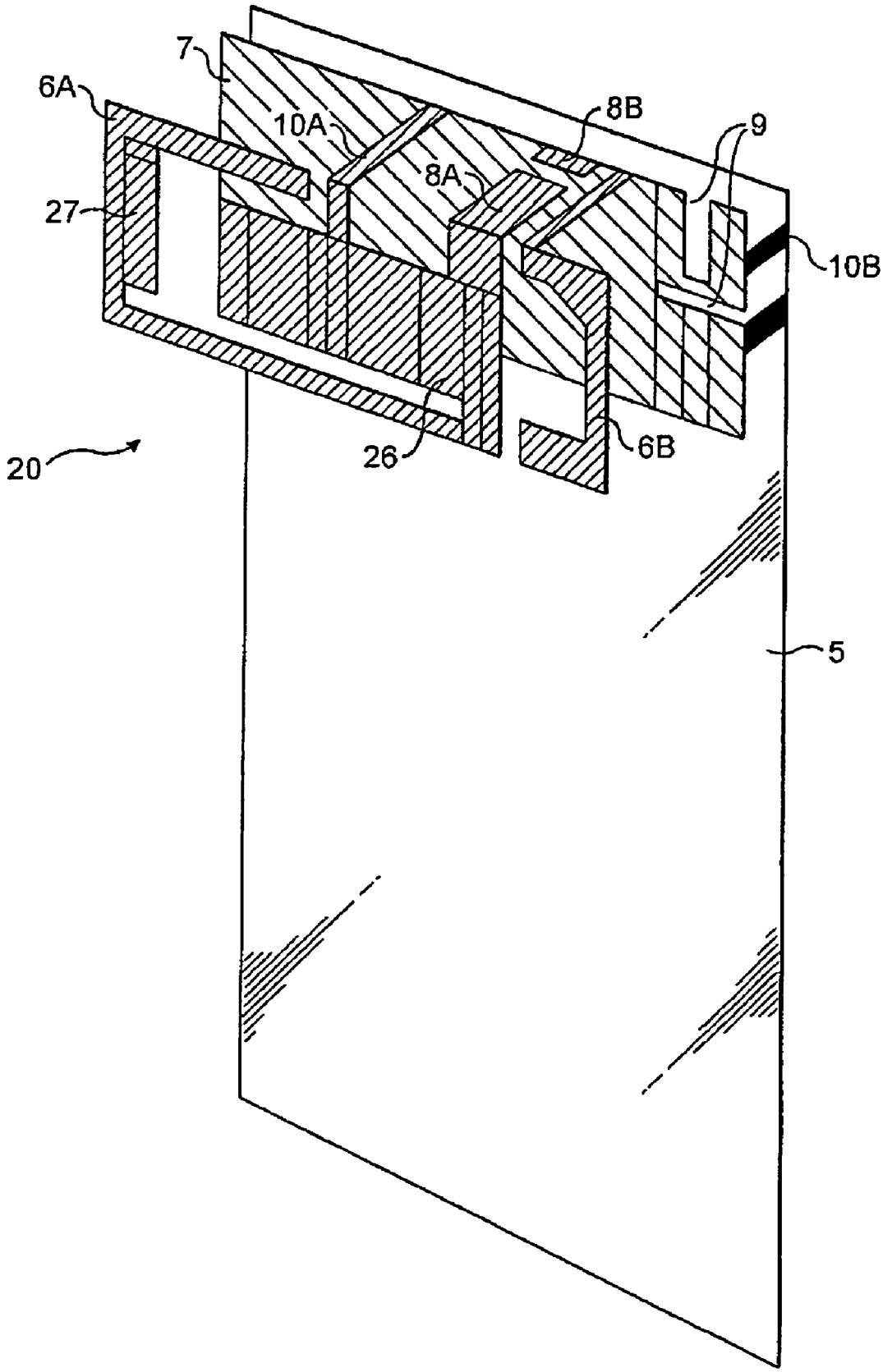
FIG. 4 shows an antenna in accordance with an embodiment of the present invention.

An exemplary arrangement is shown in FIG. 4A, where a circuit board (for example, a printed wiring board) 5 acts as the antenna's main ground plane. Alternatively, an RF shielding can or any metal part of mobile handset may be used in place of the printed wiring board (PWB) as the antenna's ground plane. Positioned above the PWB 5 of FIG. 4A is an additional plane 7, which is connected to the PWB 5 by means of conducting pins 10B.

The structure of the plane 7 need not be a PIFA since, as in the embodiment shown in FIG. 4A, it could be connected to the PWB at multiple points. Using multiple ground connections 10B provides the advantage that the current distribution across the PWB can be controlled. Conversely, the known double PIFA has just one ground connection (24 in FIG. 2), and this could result in very high current concentrated in some areas.

With multiple ground connections spread around the plane 7, the plane would not act as a quarter wave structure, but rather as a half wave structure, and to obtain resonance: at the frequencies of interest the size of the plane would need to be doubled. Due to size constraints associated with mobile handsets, doubling the area of an antenna structure would not be desirable.

Instead, the inventors of the present invention have realized that if the plane 7 is connected to the "source −" of a feed cable, the plane 7 will act as an extra ground plane in addition to the main ground plane 5, thereby providing the advantages discussed below.

The extra ground plane 7 will not be resonant in its own right, but the combined structure of resonators 6A and 6B (described in detail below) together with the ground plane 7 acts as a resonator structure which can produce up to four resonant frequencies.

By varying the position and number of the connecting pins 10B the resonances produced by the combined structure may be tuned to desired frequencies. The extra ground plane 7 may also have slots 9 cut into it in order to modify the frequency band(s) of these resonances.

Positioned above the ground plane 7 is a conducting antenna track 6A whose shape determines the frequency band(s) at which the antenna track 6A resonates. In a preferred embodiment of the invention, the antenna track 6A comprises one or more resonators (which may, for example, be conventional PIFAs), each exhibiting one or more resonances. The resonances generated are dependent upon the antenna track geometry.

Figure 3A:
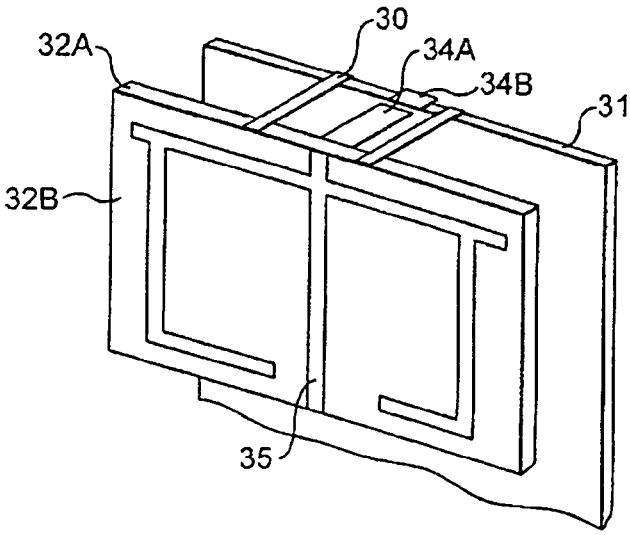
FIG. 3A: Prior Art
FIG. 3 shows a prior art slotted PIFA pair antenna.

The track 6A is electrically connected to the ground plane resonator 7 by means of a connecting element 10A. A coaxial cable could suitably be used to feed the antenna 20. As in the antenna of FIG. 3, strip 8A could conveniently be connected to the inner conductor of the coaxial cable (source +), and 8B could be connected to the outer conductor (source −), thus connecting the antenna to transmitter and receiver circuitry.

A further resonator, parasitic element 6B may be positioned adjacent to the antenna track 6A, and in substantially the same plane. This parasitic resonator is connected directly to the ground plane 7 and acts as a PIFA without a feeding pin. It is excited indirectly by the main resonator 6A rather than by a feeding cable. Its resonant frequency is determined by its dimensions.

Figure 4B:
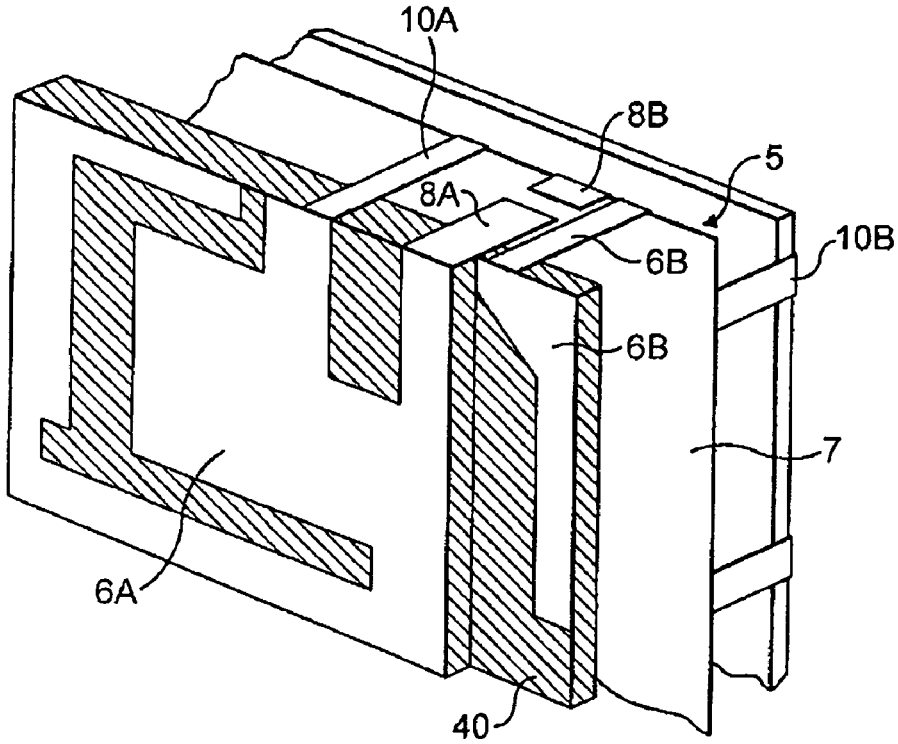

FIG. 4B shows a detailed view of the feed connections of the antenna shown in FIG. 4A.

Conveniently, the track 6A and the parasitic element 6B can be mounted on an insulating substrate 40, as shown in FIG. 4B. Suitably, the track 6A and element 6B can comprise conductive layers applied to the substrate and subsequently etched to define the resonator geometries.

In one embodiment, the antenna is made up of a dual band resonator (antenna track 6A) which comprises one part 27 for providing a resonance at one of the lower GSM bands (USGSM850 or EGSM900) and one part 26 for providing a resonance at one of the upper GSM bands (DCS1800 or PCS1900), and a parasitic resonator 6B which provides a third resonance at a third GSM band (either DCS1800 or PCS1900). The antenna described so far is a conventional tri-band antenna, suitably covering either the USGSM850, DCS1800 and PCS1900 bands or EGSM900, DCS1800 and PCS1900.

However, by adding a ground plane resonator 7 in accordance with the present invention, a further low band resonance can be created, such that the conventional tri-band antenna combined with the ground plane resonator can provide performance over all four GSM bands (USGSM850, EGSM900, DCS1800 and PCS1900). As discussed above, the ground plane alone does not add a further resonance, but rather it acts as a part of the whole resonator comprising 6A, 6B and 7 in order to add an extra resonance. The size of the ground plane is typically too small for a USGSM850 or EGSM900 resonance to be created by the ground plane alone, but the combined structure comprising 6A, 6B and 7 allows a lower band resonance within either USGSM850 or EGSM900 to be produced. Thus, in a preferred embodiment of the present invention, the antenna shown in FIG. 4 can provide resonance at each of the four GSM bands. This arrangement is advantageous compared with a conventional double-PIFA configuration in that the volume of antennas in accordance with embodiments of the invention can be smaller due to the use of a ground plane positioned below the main resonators (6A, 6B) to contribute to the obtainable frequency bands.

As an alternative to the embodiment shown in FIG. 4A in which several connecting pins are provided between the plate 7 and the main ground plane 5, the plate 7 would also act as a ground plane if a single connecting pin were provided between the plate 7 and the main ground plane 5 and additionally the "source –", or ground, of a feeding cable were connected to the plate 7. In this alternative embodiment, the plate 7 would have two ground connections—one directly to the main ground plane 5 and one via the feeding cable—and it would thus function as a ground plane.

The inventors of the present invention have found that an arrangement such as that shown in FIG. 4 can provide performance in each of the four GSM bands even within a metal mobile terminal. Whereas a known slotted PIFA pair provides bandwidths reduced by 30-40% when used in a metal handset as opposed to a conventional plastic handset, antennas in accordance with embodiments of the present invention can achieve wide bandwidths for quad-band performance. The antenna 20 of FIG. 4 is less sensitive to metallic blocks surrounding the antenna compared with conventional, slotted PIFA pair antennas, and thus has improved performance in metal handsets compared with other quad-band antenna structures. The antenna of embodiments of the present invention could suitably be used in a communications handset whose cover consists substantially of metal. The cover could suitably comprise at least 80%, at least 50% or at least 20% metal. Alternatively, embodiments of the present invention could be used in handsets having entirely plastic covers.

In an exemplary embodiment of the present invention, an antenna has the following configuration: the PWB is 35 mm×105 mm; the ground plane 7 and the antenna track 6A have length 35 mm and width 20 mm, and the antenna track 6A is positioned 10 mm above the ground plane resonator 7. It should be noted that various functional components of a mobile communications terminal may be placed between the ground plane and the PWB, and thus the relevant height of the antenna is the distance between the ground plane 7 and the track 6A.

In the exemplary embodiment, no slots are cut in the antenna's ground plane, and only two conducting pins are used to connect the ground plane and the PWB for simplicity of discussion.

The tuning of the resonant frequencies and their bandwidth is affected by adjusting the number and positions of connecting pins. The current distribution across the handset can also be controlled with careful selection of the pin positions to provide an even current distribution as opposed to high current concentrations. This can yield better antenna performance. Preferred numbers and positions of connecting pins can be determined by means of trial and error by simulating antennas having particular configurations of pins. Tests carried out by the inventors suggest that the optimum configuration is to use a single pin at the centre of each of the two side edges of the ground plane 7, and optionally further pins along the two side edges.

Figure 5:
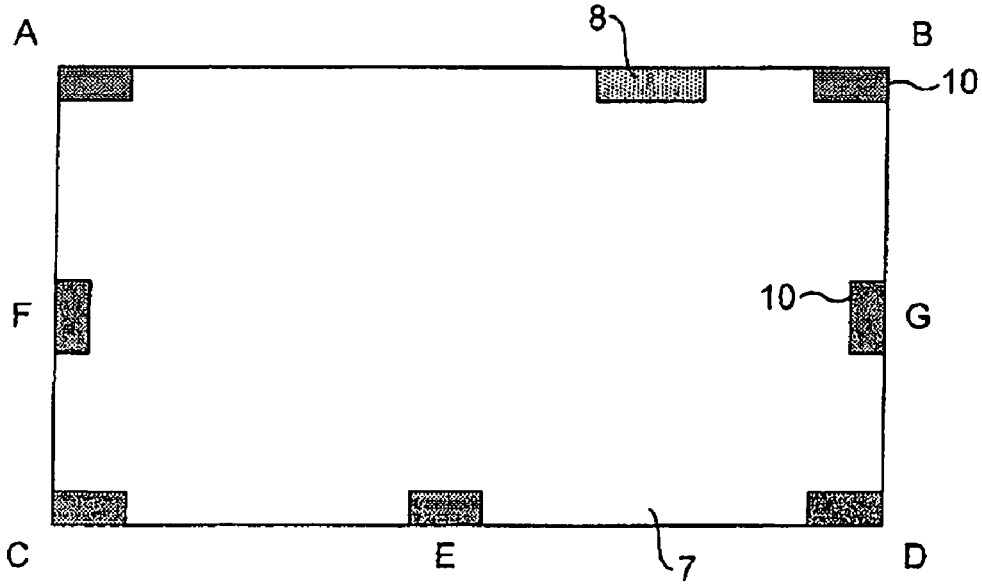
FIG. 5 shows possible locations for connectors on a ground plane of an embodiment of the present invention.

FIG. 5 shows various locations of conducting pins 10 for connecting the ground plane 7 to the PWB 5. Four specific cases are considered, in each of which different pin locations are used. These cases are not intended to be limiting, and it will be clear to the skilled person that any position or combinations of positions in addition to those discussed may be used within the scope of the invention.

Figure 6:
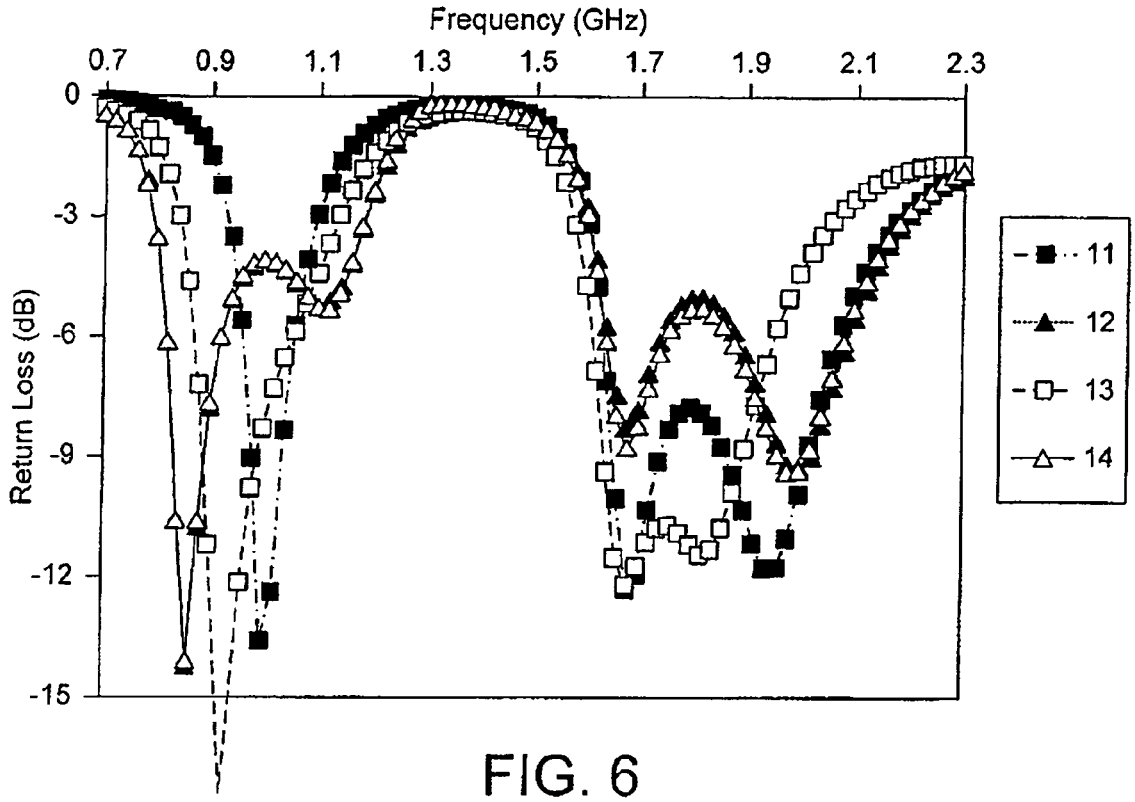
FIG. 6 is a graph of simulated return loss against frequency for various connector positions.

FIG. 6 shows a simulated return loss against frequency for each of the four considered cases. The return loss data was obtained using an IE3D simulator.

In case one, pin locations C and D are used. The simulated return loss for this case is shown as 11 in FIG. 6.

In case two, pin locations B and D are used, and the resulting simulated return loss is shown as 12 in FIG. 6.

In case three, pin locations F and G are used, and the resulting simulated return loss is shown as 13 in FIG. 6.

In case four, pin locations B and C are used, and the resulting simulated return loss is shown as 14 in FIG. 6.

In FIG. 6, the frequencies at which the antenna radiates are denoted by dips in the graphs. Thus, the number of dips in a graph indicates the number of obtainable frequencies with the respective antenna, and the greater the width of the dips, the wider the frequency ranges at which the antenna radiates. It can be seen that for each of cases two, three and four an additional resonance is generated at the lower. GSM band (USGSM850 and EGSM900). The bandwidths generated can be seen to be wide enough to allow performance at both these bands.

Figure 7:
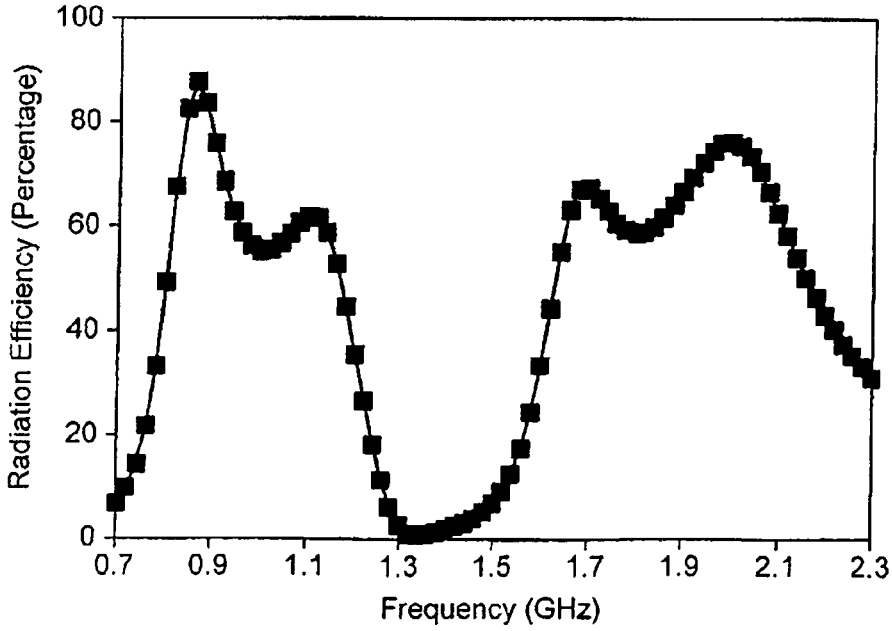
FIG. 7 is a graph of simulated radiation efficiency against frequency for a particular combination of connector positions.

FIG. 7 shows the simulated radiation efficiency for case two. It is desirable to obtain high efficiency across the frequency bands of interest, and it is not surprising that the additional resonance generated can be seen from the graph to produce strong radiation.

It should be appreciated that resonances at different frequency bands may be generated by adjusting the number, the shape and the location of the conducting pins 10 in conjunction with the slots 9 cut out of the antennas ground plane. Thus, the antenna shown in FIG. 4 can in general achieve multi-band and/or wide bandwidth performance, with high radiation efficiency and with controllable current distribution on the PWB. Embodiments of the invention provide antennas that are less affected by metal blocks compared with known antennas, and provide a more flexible feeding structure compared with slotted PIFA pairs, as discussed further below.

Figure 3B:
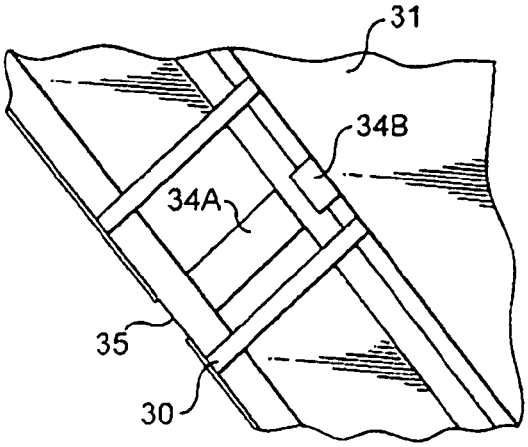
FIG. 3B: Prior Art

The structure of the known slotted PIFA pair antenna requires the feed to be positioned at or near the central line of the antenna so as to excite both elements of the PIFA pair (as shown in FIG. 3B). However, there is no such restriction on the feeding structure of the antenna of the present invention. The feed could potentially be moved to any points of the antenna track 6A if an appropriate modification were made to the shape of the antenna track.

It can be appreciated that antennas of embodiments of the present invention are suitable not only for GSM frequencies but also for any other frequencies desired for mobile communications.

The applicant draws attention to the fact that the present invention may include any feature or combination of features disclosed herein either implicitly or explicitly or any generalization thereof, without limitation to the scope of any definitions set out above. In view of the foregoing description it will be evident to a person skilled in the art that various modifications may be made within the scope of the invention.

The invention claimed is:

1. An antenna comprising:

a first substantially planar ground plate;

a first substantially planar resonator positioned in a plane substantially parallel to the first ground plate;

a second substantially planar ground plate positioned in a plane substantially parallel to the first ground plate;

two or more connectors electrically connecting the second ground plate to the first ground plate; and one or more connectors electrically connecting the first resonator to the second ground plate;

wherein:

the first resonator and the second ground plate are connected to at least one of a receiver and a transmitter by an antenna feed;

the first resonator and the second ground plate each have similar dimensions;

the first resonator is substantially aligned with the second ground plate; and the second ground plate is positioned between the first ground plate and the first resonator.

2. An antenna according to claim 1 wherein one of the two or more connectors electrically connecting the second ground plate is a ground connection of the antenna feed.

3. An antenna according to claim 1 wherein at least one of the two or more connectors electrically connecting the second ground plate connects the second ground plate to ground.

4. An antenna according to claim 1 wherein the antenna feed comprises an outer connector providing a ground connection and an inner connector providing a positive or negative voltage connection.

5. An antenna according to claim 4 wherein the first resonator is connected to the inner connector of the antenna feed.

6. An antenna according to claim 1 further comprising a substantially planar parasitic resonator positioned adjacent the first resonator and in substantially the same plane as the first resonator.

7. An antenna according to claim 6 further comprising one or more connectors for connecting the parasitic resonator to the second ground plate.

8. An antenna according to claim 1 wherein the first resonator is shaped so as to comprise a dual-band or multi-band resonator.

9. An antenna according to claim 1 wherein the second ground plate is shaped so as to provide a further resonance in addition to resonances provided by other components of the antenna.

10. An antenna according to claim 9 wherein the second ground plate has one or more slots therein.

11. An antenna according to claim 9 wherein the antenna is configured to resonate in four frequency bands.

12. An antenna according to claim 10 wherein the antenna is configured to resonate in the USGSM850, EGSM900, DCS1800 and PCS1900 frequency bands.

13. A mobile communication terminal comprising an antenna, the antenna comprising:

a first substantially planar ground plate;

a first substantially planar resonator positioned in a plane substantially parallel to the first ground plate;

a second substantially planar ground plate positioned in a plane substantially parallel to the first ground plate;

two or more connectors electrically connecting the second ground plate to the first ground plate; and one or more connectors electrically connecting the first resonator to the second ground plate;

wherein:

the first resonator and the second ground plate are connected to at least one of a receiver and a transmitter by an antenna feed;

the first resonator and the second ground plate each have similar dimensions;

the first resonator is substantially aligned with the second ground plate; and the second ground plate is positioned between the first ground plate and the first resonator.

14. A mobile communication terminal according to claim 13 wherein one of the two or more connectors electrically connecting the second ground plate is a ground connection of the antenna feed.

15. A mobile communication terminal according to claim 13 wherein at least one of the two or more connectors electrically connecting the second ground plate connects the second ground plate to ground.

16. A mobile communication terminal according to claim 13 wherein the antenna feed comprises an outer connector providing a ground connection and an inner connector providing a positive or negative voltage connection.

17. A mobile communication terminal according to claim 16 wherein the first resonator is connected to the inner connector of the antenna feed.

18. A mobile communication terminal according to claim 13 wherein the antenna further comprises a substantially planar parasitic resonator positioned adjacent the first resonator and in substantially the same plane as the first resonator.

19. A mobile communication terminal according to claim 18 wherein the antenna further comprises one or more connectors for connecting the parasitic resonator to the second ground plate.

20. A mobile communication terminal according to claim 13 wherein the first resonator is shaped so as to comprise a dual-band or multi-band resonator.

21. A mobile communication terminal according to claim 13 wherein the second ground plate is shaped so as to provide a further resonance in addition to resonances provided by other components of the antenna.

22. A mobile communication terminal according to claim 21 wherein the second ground plate has one or more slots therein.

23. A mobile communication terminal according to claim 21 wherein the antenna is configured to resonate in four frequency bands.

24. A mobile communication terminal according to claim 23 wherein the antenna is configured to resonate in the USGSM850, EGSM900, DCS1800 and PCS1900 frequency bands.

25. A mobile communication terminal according to claim 13 wherein a circuit board within the terminal comprises the first ground plate.

26. A mobile communication terminal according to claim 13 wherein a shielding comprises the first ground plate.

27. A mobile communication terminal according to claim 13 wherein a metal frame of the terminal comprises the first ground plate.

28. A mobile communication terminal according to claim 13 wherein a cover of the terminal substantially comprises metal.

29. An antenna for use in a mobile communications terminal having a first substantially planar ground plate, the antenna comprising:

a first substantially planar resonator positioned in a plane substantially parallel to the first ground plate;

a second substantially planar ground plate positioned in a plane substantially parallel to the first ground plate;

two or more connectors electrically connecting the second ground plate to the first ground plate; and one or more connectors electrically connecting the first resonator to the second ground plate;

wherein:

the first resonator and the second ground plate are connected to at least one of a receiver and a transmitter by an antenna feed;

the first resonator and the second ground plate each have similar dimensions;

the first resonator is substantially aligned with the second ground plate; and the second ground plate is positioned between the first ground plate and the first resonator.

30. An antenna comprising:

a first substantially planar ground plate;

a first substantially planar resonator positioned in a plane substantially parallel to the first ground plate;

a second substantially planar ground plate positioned in a plane substantially parallel to the first ground plate;

two or more connectors electrically connecting the second ground plate to ground; and one or more connectors electrically connecting the first resonator to the second ground plate;

wherein:

the first resonator and the second ground plate are connected to at least one of a receiver and a transmitter by an antenna feed;

the second ground plate is positioned between the first ground plate and the first resonator; and the first resonator is substantially aligned with the second ground plate.

31. A mobile communication terminal comprising an antenna, the antenna comprising:

a first substantially planar ground plate;

a first substantially planar resonator positioned in a plane substantially parallel to the first ground plate:

a second substantially planar ground plate positioned in a plane substantially parallel to the first ground plate;

two or more connectors electrically connecting the second ground plate to ground; and one or more connectors electrically connecting the first resonator to the second ground plate;

wherein:

the first resonator and the second ground plate are connected to at least one of a receiver and a transmitter by an antenna feed;

the second ground plate is positioned between the first ground plate and the first resonator; and the first resonator is substantially aligned with the second ground plate.

* * * * *